US006749952B2

(12) United States Patent
Shigekuni et al.

(10) Patent No.: US 6,749,952 B2
(45) Date of Patent: Jun. 15, 2004

(54) TIN-PLATED STEEL SHEET

(75) Inventors: Tomofumi Shigekuni, Chiba (JP); Hisatada Nakakoji, Chiba (JP); Chiaki Kato, Chiba (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 10/097,928

(22) Filed: Mar. 15, 2002

(65) Prior Publication Data

US 2002/0197505 A1 Dec. 26, 2002

(30) Foreign Application Priority Data

Mar. 21, 2001 (JP) ..... 2001-080120

(51) Int. Cl.[7] ..... B32B 15/04

(52) U.S. Cl. ..... 428/648; 428/646; 428/655; 428/668; 428/678; 428/679; 428/680; 428/681; 428/682; 428/687; 428/446; 428/450; 428/704

(58) Field of Search ..... 428/646, 648, 428/655, 668, 678, 679, 680, 681, 682, 687, 446, 450, 704

(56) References Cited

U.S. PATENT DOCUMENTS

| | | | | | |
|---|---|---|---|---|---|
| 4,104,135 | A | * | 8/1978 | Fujimaki et al. | 205/176 |
| 4,306,917 | A | | 12/1981 | Oda et al. | |
| 4,339,310 | A | * | 7/1982 | Oda et al. | 205/199 |
| 4,784,731 | A | * | 11/1988 | Higuchi et al. | 205/156 |
| 4,927,472 | A | | 5/1990 | Matsushima et al. | |
| 5,091,023 | A | * | 2/1992 | Saeki et al. | 148/247 |
| 5,427,632 | A | * | 6/1995 | Dolan | 148/259 |
| 5,728,203 | A | * | 3/1998 | Vorse et al. | 106/287.11 |

FOREIGN PATENT DOCUMENTS

| | | | | |
|---|---|---|---|---|
| EP | 391442 A1 | * | 10/1990 | C23C/22/38 |
| WO | WO 00/36176 | | 6/2000 | |
| WO | WO 01/07679 | | 2/2001 | |

* cited by examiner

*Primary Examiner*—Terrel Morris
*Assistant Examiner*—Andrew T Piziali
(74) *Attorney, Agent, or Firm*—Young & Thompson

(57) ABSTRACT

The tin-plated steel sheet includes a base steel sheet; a tin plating layer coating approximately more than 97.0% of the base steel sheet; and a chemical conversion coating having approximately 0.5 to 100 mg/m$^2$ phosphorus and approximately 0.1 to 250 mg/m$^2$ silicon formed on the tin plating layer and an unplated region corresponding to approximately less than 3.0%. The tin-plated steel sheet does not contain chromium which is harmful to the environment but has superior overcoat adhesion property, discoloration resistance, and rust resistance.

3 Claims, No Drawings

TIN-PLATED STEEL SHEET

BACKGROUND OF THE INVENTION

1. Field of the Invention

The present invention relates generally to surface-treated steel sheets for use in cans such as "drawn and ironed" (DI) cans, food cans, beverage cans, and the like. More particularly, it relates to a tin-plated steel sheet having excellent overcoat adhesion property and superior resistance to discoloration and rust.

2. Description of the Related Art

Tin-plated steel sheets are widely used as surface-treated steel sheets for use in cans. The tin-plated steel sheets are usually produced by first plating a cold-rolled steel sheet with tin and then immersing or electrolyzing the resulting plated steel sheet in an aqueous solution of hexavalent chromium compounds such as chromates or dichromates. Through such immersion or electrolysis, which is known as a chromating process, chromium oxides are formed on the plated tin layer to provide a chromate coating. The chromate coating, which prevents growth of tin oxides, suppresses "yellowing", i.e., discoloration of the tin-plated steel sheet surface to a yellowish color (hereinafter also referred to as discoloration resistance) and enhances overcoat adhesion property and resistance to rust.

However, chemical conversion treatment using an aqueous solution of hexavalent chromium compounds such as chromates or dichromates requires a significantly high cost for securing the safety of the work environment and for effluent treatment. Moreover, leakage of the liquid used in the chromating process, if caused by an accident or the like, inflicts significant damage upon the ambient environment. The recent trend toward environmental protection has promoted regulations on the use of chromium; thus, there is an increasing need for chromium-free chemical conversion treatment for the surface-treated steel sheets for use in cans having improved resistance to discoloration and rust and overcoat adhesion property.

Examples of chromium-free chemical conversion treatments for surface-treated steel sheets for use in cans which replace conventional chromating processes are as follows. Japanese Unexamined Patent Application Publication No. 55-24516 discloses a method for forming chromium-free chemical conversion coating on a tin-plated steel sheet, the method comprising direct-current electrolysis of the tin-plated steel sheet in a phosphate-system aqueous solution using the tin-plated sheet as a cathode. Japanese Unexamined Patent Application Publication No. 1-32308 discloses a chromium-free electrolytic tin-plated steel sheet for use in seamless cans, comprising a chemical conversion coating formed on a tin plating layer, the chemical conversion coating including either phosphorus (P) alone or phosphorus (P) and aluminum (Al).

However, all of the chemical conversion coatings disclosed in the above-described publications are hardly comparable to the conventional chromate coating formed using dichromic acid or chromic acid when their comprehensive performance is evaluated in terms of overcoat adhesion property and resistance to discoloration and rust.

Accordingly, it is an object of the present invention to provide a tin-plated steel sheet having excellent overcoat adhesion property and resistance to discoloration and rust without having to contain, in its chemical conversion coating, chromium, which is harmful to the environment.

SUMMARY OF THE INVENTION

The present invention provides a tin-plated steel sheet comprising: a base steel sheet; a tin plating layer coating approximately more than 97.0% of the base steel sheet; and a chemical conversion coating having approximately 0.5 to 100 mg/m$^2$ phosphorus and approximately 0.1 to 250 mg/m$^2$ silicon formed on the tin plating layer and an unplated region corresponding to approximately less than 3.0%.

Preferably, silicon contained in the chemical conversion coating is derived from a silane coupling agent. More preferably, the silane coupling agent contains an epoxy group.

The tin-plated steel sheet may further comprise an alloy layer disposed on the base steel sheet and at least beneath the tin plating layer.

Preferably, the alloy layer comprises at least one layer selected from the group consisting of a Fe—Sn alloy layer, a Fe—Ni alloy layer, a Sn—Ni alloy layer, and a Fe—Sn—Ni alloy layer. More preferably, the alloy layer comprises a composite alloy layer comprising a Fe—Ni alloy layer having a mass ratio Ni/(Fe+Ni) in the range of approximately 0.02 to 0.50 and a Fe—Sn—Ni alloy layer disposed on the Fe—Ni alloy layer.

Preferably, the total Sn content of the tin plating layer and the alloy layer is in the range of approximately 0.4 to 6.0 g/m$^2$.

DESCRIPTION OF THE PREFERRED EMBODIMENTS

The present invention will now be described in detail.

Chromium-free chemical conversion coatings formed on tin plating layers by known methods rarely achieve all of the required overcoat adhesion property and resistance to discoloration and rust, which are the key properties of steel sheets for use in cans.

The present inventors have conducted extensive research to overcome the above problem of tin-plated steel sheets and found that all of the above required properties can be fulfilled by forming a chemical conversion coat containing phosphorus (P) and silicon (Si) on a tin plating layer.

In particular, a chemical conversion solution containing P and a silane coupling agent is used to form a chemical conversion coating containing adequate amounts of P and Si on the tin plating layer. Alignment of the functional groups contained in the silane coupling agent enhances the adhesion property to the overcoat for inner surfaces of cans. That is, the chemical conversion coating improves compatibility and reactivity to the overcoat and thereby yields superior overcoat adhesion property. Moreover, the chemical conversion coating functions as a protective coating to improve resistance to discoloration and rust.

The detailed configuration of the present invention will now be described.

In the tin-plated steel sheet of the present invention, the base steel plate needs to have at least one surface satisfying the requirements of the present invention. No limit is imposed as to the type of the base steel sheet; a cold-rolled steel sheet is generally employed.

The present invention can be applied to a tin-plated steel sheet. The tin-plated steel sheet may be formed by directly plating a base steel sheet with tin or by forming an alloy layer on the base steel sheet and then plating the alloy layer with tin. For example, a tin-plated steel sheet according to an embodiment of the present invention has a tin plating layer directly formed on almost the whole surface of a base steel sheet with a coating coverage exceeding 97%. Another embodiment of a tin-plated steel sheet has an alloy layer between the tin plating layer and the base steel sheet. In this embodiment also, the coating coverage by the tin plating layer exceeds 97%; accordingly, an unplated portion may remain at less than 3.0%. The unplated portion may be the base steel sheet or the alloy layer. In the present invention, the term "coating coverage" refers to the percentage of the surface of the material to be plated covered by the tin plating layer. In this invention, a sufficient resistance to rust can be obtained with a coating coverage, i.e., the percentage of the base steel sheet and/or the alloy layer covered by the tin plating layer, exceeding 97%.

As described above, the present invention includes an embodiment in which an alloy layer is provided on the base steel sheet and at least beneath the tin plating layer. The alloy layer preferably includes at least one selected from a Fe—Sn alloy layer, a Fe—Ni alloy layer, a Sn—Ni alloy layer, and a Fe—Sn—Ni alloy layer. More preferably, the alloy layer is a composite alloy layer comprising a Fe—Ni alloy layer having a Ni/(Fe+Ni) mass ratio of approximately 0.02 to 0.50 and a Fe—Sn—Ni alloy layer on the Fe—Ni alloy layer. This alloy layer, which has also been employed in the conventional tin-plated steel sheets, improves resistance to corrosion and rust. Since the hardness of the alloy layer is high compared to that of the tin plating layer, the alloy layer degrades the workability. When the tin-plated steel sheet of the present invention is applied to DI cans requiring high workability, the tin plating layer is preferably formed directly on the base steel sheet without the alloy layer.

Next, a specific method for making the alloy layer is explained.

Generally, in making a Fe—Sn alloy layer, tin plating is first directly performed on a base steel sheet and then heating is performed to melt Sn. This heating is called a reflow process and is a simple, easy process for forming the Fe—Sn alloy layer.

In making a Fe—Sn—Ni alloy layer, a common preliminary process of Ni plating such as Ni flash plating or Ni diffusion is performed on a base steel sheet. Tin plating is then performed followed by a reflow process to melt the plated tin by heating so as to make the Fe—Sn—Ni alloy layer. When Ni flash plating is performed in making the alloy layer, the Ni coating weight is preferably in the range of approximately 0.005 to 0.05 g/m$^2$. At a coating weight of 0.005 g/m$^2$ or more, sufficient corrosion resistance can be obtained. At a coating weight of 0.05 g/m$^2$ or less, the dissolving rate of Sn under a corrosive environment can be decreased and sufficient rust resistance can be obtained.

In making a Ni—Sn alloy layer, Ni flash plating and then tin plating are performed. In this manner, Ni and Sn are alloyed at normal temperatures without a reflow process, and the Ni—Sn alloy layer can be easily formed. In this case also, sufficient rust resistance can be achieved by controlling the amount of Ni coating within the above-described range.

In making a composite alloy layer comprising a Fe—Ni alloy layer and a Fe—Sn—Ni alloy layer on the Fe—Ni alloy layer, a base steel sheet is first plated with Ni, and annealing is performed in a 10 vol. % $H_2$+90 vol. % $N_2$ atmosphere at approximately 700° C. in order to diffuse Ni and to form the Fe—Ni alloy layer. Next, the Fe—Ni alloy layer is plated with tin and is heated at a temperature above the melting point of Sn to form the Fe—Sn—Ni alloy layer, thereby forming the composite alloy layer. Note that in making the composite alloy layer, the mass ratio Ni/(Fe+Ni) in the Fe—Ni alloy layer is preferably in the range of approximately 0.02 to 0.50. At a mass ratio of Ni/(Fe+Ni) of approximately 0.02 or more, sufficient corrosion resistance can be obtained. At a mass ratio of Ni/(Fe+Ni) of approximately 0.50 or less, the dissolving rate of Sn under a corrosive environment can be decreased and improved resistance to rust can be obtained. Moreover, the Fe—Ni alloy layer alone can exhibit improved corrosion resistance when the Fe—Ni layer has Ni diffused therein at a mass ratio of Ni/(Fe+Ni) in the range of approximately 0.02 to 0.50. The mass ratio of Ni/(Fe+Ni) can be obtained by analyzing Fe and Ni in the depth direction using micro auger electron spectroscopy ($\mu$-AES), integrating the product of each relative sensitivity coefficient and each peak value with respect to the depth, and calculating using the following formula: the integrated value of Ni/(the integrated value of Ni+the integrated value of Fe).

In the present invention, the total coating weight of tin contained in the tin plating layer and the alloy layer is preferably in the range of approximately 0.4 to 6.0 g/m$^2$. This is because a Sn coating weight of approximately 0.4 g/m$^2$ or more is enough to obtain sufficient resistance to rust. At a Sn coating weight exceeding approximately 6.0 g/m$^2$, however, the cost becomes high although the performance is satisfactory. More specifically, the term "the total coating weight of tin" refers to the amount of tin contained in the tin plating layer when no tin is contained in the alloy or when no alloy layer is provided. When Sn is contained in the alloy layer, the term refers to the amount of Sn contained in the tin plating layer and the amount of Sn contained in the alloy layer in total. The Sn coating weight can be measured by coulometric analysis or surface analysis using fluorescent X-rays.

Another important feature of the present invention is to provide a chemical conversion coating containing approximately 0.5 to 100 mg/m$^2$ of phosphorus (P) and approximately 0.1 to 250 mg/m$^2$ of silicon (Si) on the tin plating layer coating approximately more than 97.0% and on the unplated portion not covered by the tin plating layer which is approximately less than 3.0%. The unplated portion is either base steel sheet or the alloy layer. In the present invention, this coating is provided on the tin plating layer as well as the unplated portion. This coating, also referred to as "chemical conversion coating" in this specification, is preferably formed using a chemical conversion solution containing phosphorus and silane coupling agent.

The P content in the coating must be in the range of approximately 0.5 to 100 mg/m$^2$. At a content of 0.5 mg/m$^2$ or more, sufficient overcoat adhesion property and resistance to discoloration can be achieved. The upper limit is approximately 100 mg/m$^2$ because defective coating can be prevented and sufficient overcoat adhesion property and workability can be obtained. The P content can be measured by surface analysis using fluorescent X-rays, for example.

The chemical conversion coating containing P is preferably formed by a phosphate-system chemical conversion. The chemical conversion solution preferably contains free phosphoric acid, a metal phosphate such as sodium phosphate, aluminum phosphate, potassium phosphate or the like, and/or monohydrogenphosphate as the supply source of phosphorus at an amount of approximately 1 to 80 g/l in terms of phosphate ions. The chemical conversion solution may further contain a salt including Sn, Fe, or, Ni, such as $SnCl_2$, $FeCl_2$, $NiCl_2$, $SnSO_4$, $FeSO_4$, $NiSO_4$, or the like. In such a case, an oxidizing agent such as sodium chlorate, nitrite, or the like and an etchant such as fluorine ions may be added as an accelerator, if necessary. The chemical conversion coating containing phosphorus can be formed by immersion or electrolysis of the tin-plated steel sheet using a phosphate-system chemical conversion solution.

The Si content in the chemical conversion coating must be in the range of approximately 0.1 to 250 mg/m$^2$. Si contained in the coating is preferably introduced from the silane coupling agent contained in the chemical conversion solution. A typical chemical conversion solution can be expressed as RSi(—X) (—OR')$_2$ or as XSi(—OR")$_3$, wherein R, R' and R" are alkyls of the same or different types and X is a monovalent substituent.

The silane coupling agent forms a silanol group (≡Si—OH) by hydrolysis of the alkoxysilyl group (≡Si—OR') and adheres onto the metal surface by a condensation reaction with a hydroxyl group (—OH) present on the metal surface. The substituent X in the above formula readily aligns with the overcoat or resin disposed thereon so as to be compatible with or bonded to these overcoatings.

Examples of the silane coupling agent are 3-methacryloxypropyltrimethoxysilane, 2-(3,4-epoxycyclohexyl)ethyltrimethoxysilane, 3-glycidoxypropyltrimethoxysilane, N-2-(aminoethyl)-3-aminopropyltrimethoxysilane, N-2-(aminoethyl)-3-aminopropylmethyldimethoxysilane, 3-aminopropyltriethoxysilane, N-phenyl-3-aminopropyltrimethoxysilane, 3-mercaptopropylmethoxysilane, 3-chloropropyltrimethoxysilane, vinyltriethoxysilane, vinyltris (2-methoxyethoxy) silane, N-2-(aminoethyl)-3-aminopropyltrimethoxysilane, N-2-(aminoethyl)-3-aminopropylmethyldimethoxysilane, and 3-aminopropyltriethoxysilane. A silane coupling agent having a substituent X including an epoxy group is especially preferable. Examples of such silane coupling agents are 2-(3,4-epoxycyclohexyl)ethyltrimethoxysilane and 3-glycidoxypropyltrimethoxysilane. This is because they have excellent compatibility and reactivity to the epoxy-system overcoat used to coat the inner surfaces of the can.

In the present invention, the Si content in the chemical conversion coating is in the range of approximately 0.1 to 250 mg/m$^2$ because the overcoat adhesion property can be significantly improved thereby. Sufficient overcoat adhesion property can be obtained at a Si content of approximately 0.1 mg/m$^2$ or more. The upper limit is approximately 250 mg/m$^2$ because self condensation of the unreacted moiety of the silane coupling agent can be prevented without degrading the overcoat adhesion property. The Si content can be measured by surface analysis using fluorescent X-rays.

To form the coating containing P and Si, a chemical conversion coat containing P is first formed using the above-described phosphate-system chemical conversion solution and then treating the resulting coating in a solution of a silane coupling agent diluted with water. Note that when the treatment is performed using the solution of the silane coupling agent diluted with water, repelling may occur due to the poor wettability of the surface. The repelling can be prevented using a solution containing alcohol. For example, a solution containing approximately 50 mass % or more of ethanol, approximately 0.5 to 20 mass % of silane coupling agent, and the balance being water can be used to achieve uniform treatment. The treatment using the solution containing the silane coupling agent can be performed by application and drying or by immersion. When the silane coupling agent is added to the above-described phosphate-system chemical conversion solution for forming a coat containing P, a chemical conversion coat containing P and Si can be formed using only one solution. In this case, the pH of the chemical conversion solution is controlled within the range of approximately 1.5 to 5.5 so as to homogeneously dissolve the silane coupling agent in the chemical conversion solution and to achieve excellent overcoat adhesion property. The mass ratio Si/P in the chemical conversion coat is preferably in the range of approximately 0.05 to 100, since the overcoat adhesion property and the corrosion resistance after application of the overcoat can be remarkably improved.

As described above, the present invention fulfills all the requirements of excellent overcoat adhesion property and superior resistance to discoloration and rust by providing a coat containing P and Si in the above-described amount on a tin plating layer formed on a surface of the steel sheet.

Next, an exemplary method for making the tin plated steel sheet of the present invention will be described. For the purpose of the explanation, the alloy layer is formed as a composite alloy layer having an Fe—Ni alloy layer and an Fe—Sn—Ni alloy layer on the Fe—Ni alloy layer.

As described above, the Fe—Ni alloy layer is first formed by diffusion of Ni in the base steel sheet. Next, tin plating is performed thereon, and, subsequently, reflow treatment is performed at a temperature above the melting point of tin (231.9° C.) to form a composite alloy layer having an Fe—Sn—Ni alloy layer on the Fe—Ni alloy layer. Next, a chemical conversion treatment is performed by immersing the tin-plated steel sheet having the composite alloy layer thereon into a chemical conversion solution. Note that in the present invention, in order to remove tin oxides formed on the surface after the reflow treatment, cathodic treatment may be performed at approximately 1 C/dm$^2$ in an approximately 15 g/l sodium carbonate aqueous solution.

The chemical conversion solution is prepared by adding approximately 0.5 to 20.0 mass % of a silane coupling agent to an aqueous solution containing approximately 1 to 80 g/l of phosphoric acid based on phosphate ions, approximately 0.001 to 10 g/l of stannous chloride based on stannous ions, and approximately 0.1 to 1.0 g/l of sodium chlorate. The temperature of the chemical conversion is preferably approximately 40 to 60° C., and the immersion time is preferably approximately 1 to 5 seconds. In this particular example, the chemical conversion is performed at a temperature of 50° C. for an immersion time of 5 seconds. The tin-plated steel sheet after the chemical conversion is dried by hot air of approximately 35 to 150° C.

Another method for forming the chemical conversion coat includes treating the tin-plated steel sheet with a chemical conversion solution not containing the silane coupling agent, uniformly applying the silane coupling solution on the resulting tin-plated steel sheet so as to form a silane coupling layer, and drying the resulting sheet by heating the steel sheet to a surface temperature of approximately 50 to 150° C. In such a case, a silane coupling solution containing, for example, approximately 50 mass % or more of ethanol approximately 0.5 to 20 mass % of the silane coupling agent, and the balance being water, can be used.

EXAMPLES

Next, the present invention is described by way of examples.

Examples 1 to 12

Each of Examples 1 to 12 was prepared by forming a tin plating layer either directly on a cold-rolled low-carbon steel sheet having a thickness of 0.25 mm or on an alloy layer formed on the steel sheet. The coating weight of tin per surface was in the range of 0.4 to 6.0 g/m$^2$. Details of the coating weight and the coating coverage of the tin plating are shown in Table 1. Next, a chemical conversion coat was formed on each tin-plated steel sheet under the conditions shown in Table 2. The composition of each chemical conversion coat is shown in Table 3.

Comparative Examples 1 to 9

For comparison purposes, tin-plated steel sheets each having at least one of the alloy layer, the tin plating layer, and the chemical conversion coat, which are beyond the scope of the invention, were prepared. These conditions are also shown in Tables 1 to 3.

Performance Evaluation

The tin-plated steel sheets of Examples 1 to 12 and Comparative Examples 1 to 9 were evaluated in terms of overcoat adhesion property, corrosion resistance after application of the overcoat, discoloration resistance, and rust resistance.

(1) Overcoat Adhesion Property

An epoxy-phenol-system overcoat was applied at a coating weight of 50 mg/dm$^2$ on the surface of each tin-plated steel sheet and was baked at 210° C. for 10 minutes. Then two tin-plated steel sheets which had been subjected to overcoat application and baking were stacked with their coated surfaces facing each other sandwiching a nylon adhesive film and were bonded at a pressure of $2.94\times10^5$ Pa at a temperature of 190° C. for 30 seconds to form a laminate. The same adhesive film and the same overcoat were used for all of the Examples and Comparative Examples. Subsequently, the laminate was cut into 10 test pieces each having a width of 5 mm. Five of the ten test pieces were subjected to a T-peel test to determine the peel strength using a tensile tester and the primary overcoat adhesion property was evaluated based on the average value. The remaining five test pieces were immersed in a 1.5 mass % NaCl+1.5 mass % citric acid solution for seven days at a temperature of 55° C. and were subjected to the T-peel test to determine the peel strength using the tensile tester to evaluate the secondary overcoat adhesion property based on the average value. The evaluation results are shown in Table 3. In Table 3, the strength of a test piece having a width of 5 mm was evaluated to be excellent when the value was 68.6 [N] or more, represented by "E" in the table, good when the value was 49.0 [N] or more but less than 68.6 [N], represented by "G" in the table, average when the value was 29.4 [N] or more but less than 49.0 [N], represented by "Av." in the table, and poor when the value was less than 29.4 [N], represented by "P" in the table.

(2) Corrosion Resistance After Application of Overcoat

An epoxy-phenol-system overcoat was applied on the surface of each tin-plated steel sheet at a coating weight of 50 mg/dm$^2$ and was baked at 210° C. for 10 minutes. The overcoated surface was cross-cut with a cutter knife and was immersed in a 1.5 mass % NaCl+1.5 mass % citric acid solution for four days at a temperature of 55° C. Subsequently, the test piece was rinsed with water and dried. The cross-cut portion was peeled using an adhesive tape to determine the width of the coating which had peeled off and to evaluate the corrosion resistance after the application of the overcoat. The results are shown in Table 3. In Table 3, the corrosion resistance was evaluated as good at a peeled width of less than 0.4 mm, which is represented by "G" in the table, average at a peeled width of 0.4 mm or more but less than 0.8 mm, which is represented by "Av." in the table, and poor at a peeled width of 0.8 mm or more, which is represented by "P" in the table.

(3) Discoloration Resistance

Each tin-plated steel sheet was left to stand in a humidistat and thermostat vessel at 40° C. and 85% relative humidity for 60 days and the discoloration of the surface was observed. The results are shown in Table 3. In Table 3, the tin-plated steel sheet was evaluated as good when discoloration was not observed, which is represented by "G", and as poor when discoloration was observed, which is represented as "P".

(4) Rust Resistance

Each tin-plated steel sheet was exposed alternately every 30 minutes to a high-humidity environment at a temperature of 50° C. and a relative humidity of 98% and to a dry environment at a temperature of 25° C. and a relative humidity of 60% to examine the number of days taken for rust to appear on its surface. The results are shown in Table 3. In Table 3, a test piece that did not have rust appear for 30 days or more was evaluated as good, which is represented by "G", a test piece that had rust appear in 15 to less than 30 days was evaluated as average, which is represented by "Av.", and a test piece that had rust appear in less than 15 days was evaluated as poor, which is represented by "P".

As is apparent from Table 3, all of Examples 1 to 12 exhibited superior overcoat adhesion property, corrosion resistance after application of the overcoat, discoloration resistance, and rust resistance. In contrast, Comparative Examples 1 to 9 had at least one of the overcoat adhesion property, the corrosion resistance after the application of overcoat, the discoloration resistance, and rust resistance that is poor and thus not suitable for practical application.

As described above, the present invention provides a tin-plated steel sheet having excellent overcoat adhesion property, discoloration resistance, and rust resistance without using chromium and which is not harmful to the environment. Thus, the tin-plated steel sheet of the present invention can be safely applied to various industrial usages including surface-treated steel sheets for cans such as food cans and beverage cans.

It should be noted that the above description illustrates examples of the present invention; various modifications are possible without departing from the scope of the present invention set forth in the claims below.

TABLE 1

| | Alloy Layer | Total Sn coating Weight (g/m$^2$) | Sn plating layer coating coverage (%) |
|---|---|---|---|
| Example 1 | Not provided | 2.80 | 99.9 |
| Example 2 | Not provided | 2.20 | 99.9 |
| Example 3 | Not provided | 0.45 | 97.5 |
| Example 4 | Fe—Sn single layer | 1.20 | 98.2 |
| Example 5 | Fe—Sn single layer | 5.60 | 99.9 |
| Example 6 | Fe—Sn—Ni single layer (Ni = 0.030 g/m$^2$) | 1.00 | 98.0 |
| Example 7 | Fe—Sn—Ni single layer (Ni = 0.048 g/m$^2$) | 5.60 | 99.9 |
| Example 8 | Fe—Sn—Ni/Fe—Ni composite alloy layer (Ni mass ratio of the Fe—Ni layer: Ni/(Fe + Ni) = 0.20) | 3.80 | 98.0 |

TABLE 1-continued

| | Alloy Layer | Total Sn coating Weight ($g/m^2$) | Sn plating layer coating coverage (%) |
|---|---|---|---|
| Example 9 | Fe—Sn—Ni/Fe—Ni composite alloy layer (Ni mass ratio of the Fe—Ni layer: Ni/(Fe + Ni) = 0.48) | 5.90 | 99.9 |
| Example 10 | Sn—Ni single layer (Ni = 0.007 $g/m^2$) | 1.68 | 99.5 |
| Example 11 | Fe—Ni single layer (Ni/(Fe + Ni) = 0.35) | 2.24 | 99.9 |
| Example 12 | Fe—Ni single layer (Ni/(Fe + Ni) = 0.03) | 3.36 | 99.9 |
| Comparative Example 1 | Not provided | 0.35 | 96.5 |
| Comparative Example 2 | Fe—Sn single layer | 6.10 | 99.9 |
| Comparative Example 3 | Fe—Sn—Ni single layer (Ni = 0.003 $g/m^2$) | 1.20 | 85.0 |
| Comparative Example 4 | Fe—Sn—Ni single layer (Ni = 0.060 $g/m^2$) | 0.45 | 65.0 |
| Comparative Example 5 | Fe—Ni single layer (Ni/(Fe + Ni) = 0.01) | 2.80 | 99.9 |
| Comparative Example 6 | Fe—Sn—Ni/Fe—Ni composite alloy layer (Ni mass ratio of the Fe—Ni layer: Ni/(Fe + Ni) = 0.55) | 1.80 | 80.0 |
| Comparative Example 7 | Not provided | 3.60 | 99.9 |
| Comparative Example 8 | Fe—Sn single layer | 2.20 | 99.9 |
| Comparative Example 9 | Fe—Sn—Ni single layer (Ni = 0.048 $g/m^2$) | 5.60 | 99.9 |

TABLE 2

| Types of Chemical Conversion Solution | Composition of Chemical | Conversion Solution | Method of Chemical Conversion Treatment |
|---|---|---|---|
| A | phosphoric acid | 1 to 80 g/l | Immersion |
| | silane coupling agent (a) | 0.5 to 20 mass % | |
| | stannous chloride | 0.001 to 10 g/l | |
| | sodium chlorate | 0.1 to 1.0 g/l | |
| B | phosphoric acid | 1 to 80 g/l | Immersion |
| | silane coupling agent (b) | 0.5 to 20 mass % | |
| | ferrous chloride | 0.001 to 10 g/l | |
| | sodium chlorate | 0.1 to 1.0 g/l | |
| C | phosphoric acid | 1 to 80 g/l | Electrolysis |
| | silane coupling agent (c) | 0.5 to 20 mass % | |
| | nickel chloride | 0.001 to 10 g/l | |
| | sodium chlorate | 0.1 to 1.0 g/l | |
| D | phosphoric acid | 1 to 80 g/l | Immersion |
| | stannous chloride | 0.001 to 10 g/l | |
| | sodium chlorate | 0.1 to 1.0 g/l | |
| | | + | + |
| | silane coupling agent (d) | 0.5 to 20 mass % | Application |
| | ethanol | 50 to 99 mass % | |
| | water | 0 to 1 mass % | |

silane coupling agent (a): 3-glycidoxypropyltrimethoxysilane (epoxy system)
silane coupling agent (b): 2-(3,4-epoxycyclohexyl)ethyltrimethoxysilane (epoxy system)
silane coupling agent (c): N-2-(aminoethyl)-3-aminopropyltrimethoxysilane (amine system)
silane coupling agent (d): vinylethoxysilane

TABLE 3

| | Chemical Conversion Coating | | | Performance Evaluation | | | | |
|---|---|---|---|---|---|---|---|---|
| | Types of Chemical Conversion Solution | P Coating Weight ($mg/m^2$) | Si Coating Weight ($mg/m^2$) | Overcoat Adhesion Property Primary | Overcoat Adhesion Property Secondary | Corrosion Resistance after Overcoating | Discoloration Resistance | Rust Resistance |
| Example 1 | A | 0.7 | 0.30 | E | G | Av. | G | G |
| Example 2 | A | 1.5 | 2.50 | E | G | Av. | G | G |
| Example 3 | A | 90.0 | 120.00 | E | E | Av. | G | G |
| Example 4 | A | 7.0 | 10.00 | E | E | G | G | G |
| Example 5 | A | 10.0 | 12.00 | E | E | G | G | G |
| Example 6 | A | 15.0 | 25.00 | E | E | G | G | G |
| Example 7 | A | 20.0 | 50.00 | E | E | G | G | G |
| Example 8 | A | 8.0 | 9.00 | E | E | G | G | G |
| Example 9 | A | 12.0 | 12.00 | E | E | G | G | G |
| Example 10 | B | 15.0 | 30.00 | E | E | Av. | G | G |
| Example 11 | C | 2.0 | 5.00 | E | E | Av. | G | G |
| Example 12 | D | 0.9 | 240.00 | E | G | Av. | G | G |
| Comparative Example 1 | A | 20.0 | 25.00 | E | E | P | G | P |
| Comparative Example 2 | A | 0.3 | 7.00 | Av. | P | Av. | P | G |
| Comparative Example 3 | A | 7.0 | 0.05 | Av. | P | P | P | P |
| Comparative Example 4 | B | 115.0 | 180.00 | Av. | P | Av. | G | P |
| Comparative Example 5 | C | 3.0 | 0.00 | P | P | P | P | G |
| Comparative Example 6 | D | 0.0 | 15.00 | Av. | P | P | G | P |
| Comparative Example 7 | Chromate:Ox.Cr*=5mg/$m^2$ | | | Av. | P | P | G | G |
| Comparative Example 8 | — | 0.0 | 0.00 | P | P | P | P | Av |
| Comparative Example 9 | D | 12.0 | 270.00 | Av. | P | Av. | G | G |

*"Ox. Cr" represents chromium in the form of oxides.

What is claimed is:

1. A tin-plated steel sheet comprising:

a base steel sheet;

a tin plating layer coating approximately more than 97.0% of the base steel sheet;

an alloy layer comprises at least one layer selected from the group consisting of a Fe—Sn alloy layer, a Fe—Ni alloy layer, a Sn—Ni alloy layer, and a Fe—Sn—Ni alloy layer disposed on the base steel sheet and at least beneath the tin plating layer; and a chemical conversion coating having approximately 0.5 to 100 $mg/m^2$ phosphorus and approximately 0.1 to 250 $mg/m^2$ silicon, wherein the silicon is derived from a silane coupling agent, but exclusive of chromium, formed on the tin plating layer and an unplated region corresponding to less than 3.0%, wherein the alloy layer comprises a composite alloy layer comprising a Fe—Ni alloy layer having a mass ratio Ni/(Fe+Ni) in the range of approximately 0.02 to 0.50 and a Fe—Sn—Ni alloy layer disposed on the Fe—Ni alloy layer.

2. The tin-plated steel sheet according to claim 1, wherein the silane coupling agent contains an epoxy group.

3. The tin-plated steel sheet according to claim 1, wherein the total Sn content of the tin plating layer and the alloy layer is in the range of approximately 0.4 to 6.0 $g/M^2$.

* * * * *